US005809736A

United States Patent [19]

Naito et al.

[11] Patent Number: 5,809,736

[45] Date of Patent: Sep. 22, 1998

[54] METHOD AND APPARATUS FOR INJECTING CONCRETE REPAIRING AGENT INTO A CONCRETE STRUCTURE

[75] Inventors: Noboru Naito; Yuichiro Hayashi, both of Sakata, Japan

[73] Assignee: Hayashi Kensetsu Kogyo Kabushiki Kaisha, Yamagata-Ken, Japan

[21] Appl. No.: 628,856

[22] Filed: Apr. 5, 1996

[30] Foreign Application Priority Data

Apr. 6, 1995 [JP] Japan ..... 7-106979

[51] Int. Cl.[6] ..... E04G 21/24; E04G 23/02

[52] U.S. Cl. ..... 52/742.14; 52/514; 52/741.3; 52/741.4; 52/742.16

[58] Field of Search ..... 52/742.13, 742.14, 52/742.16, 741.4, 741.3, 514, 514.5

[56] References Cited

U.S. PATENT DOCUMENTS 4,905,430 3/1990 Schmidt ..... 52/514.5
5,155,965 10/1992 Tabei et al. ..... 52/514 X
5,309,692 5/1994 Hayashi et al. .
5,329,740 7/1994 Hayashi et al. .

FOREIGN PATENT DOCUMENTS 280180 11/1989 Japan ..... 52/514

*Primary Examiner*—Carl D. Friedman
*Assistant Examiner*—Timothy B. Kang
*Attorney, Agent, or Firm*—Sughrue, Mion, Zinn, Macpeak & Seas, PLLC

[57] ABSTRACT

An injection plug device for injecting an epoxy resin repairing agent into an arcuate injection groove formed in a concrete structure. A rod member made of the same or similar epoxy resin as the repairing agent, is inserted and attached in the groove and has an injection hole at its center through which the repairing agent is injected. A tube member protrudes from the center of the rod member and has an inner end portion communicating with the injection hole of the rod member. A pipe member is inserted into the tube member, and a check valve mechanism is provided between the inner end portions of the pipe member and the tube member. After the resin is injected into the concrete structure and the resin is solidified, the pipe member is easily broken and removed from the rod member, together with the pipe member and the check valve mechanism.

11 Claims, 6 Drawing Sheets

METHOD AND APPARATUS FOR INJECTING CONCRETE REPAIRING AGENT INTO A CONCRETE STRUCTURE

BACKGROUND OF THE INVENTION

The present invention relates to an injection plug device for injecting a concrete repairing agent into a void or crack in a concrete wall and an injection method carried out using the plug device.

A typical concrete wall consists of an inner concrete body and an outer mortar layer 2 mm–3 cm thick for covering and decorating the rough surface of the inner concrete body. Degradation caused by aging of the concrete may cause separation of the mortar layer from the surface of the concrete body, forming voids called "floating areas" between them. To repair the degraded concrete wall, a repairing agent such as epoxy resin or polymer cement comprising super fine particles of cement is injected into the void using various injection devices.

Japanese patent application S62-82174 discloses a method for repairing the surface of concrete walls, in which a groove is formed in the wall to the depth of the voids, then particles of concrete produced and scattered during the formation of the groove are removed from the wall, then an injection plug device called an injector is attached to the groove by adhesion, and a repairing agent is injected into the void through the injection plug device and the groove. This method is very troublesome, and it takes a long time to remove the injection plug from the wall and smooth the surface by grinding off the remaining adhesive from the wall after the injected repairing agent solidifies.

In U.S. Pat. No. 5,309,692, U.S. Pat. No. 5,329,740 and Japanese patent application H6-240624, injection plug devices for injecting concrete repairing agents, all invented by the present inventors, are disclosed which are detachably insertable into an arcuate groove formed in the concrete wall to be repaired. These injection plug devices have proven very successful when used for injecting fine-particle polymer cement having a relatively small adhesive force.

The injection plug devices described above have a problem in that they cannot be removed easily from the wall after the injected repairing agent has solidified, especially when epoxy resin or the like having a strong adhesive force is used as the repairing agent.

Another problem is that the above-described repairing method is expensive, because the injection plug devices, which have complex and expensive mechanisms to attach them to the wall detachably, must be disposable, because it is difficult to remove the repairing agent from the inner portion of the plug device after it has solidified.

SUMMARY OF THE INVENTION

Therefore, an object of the invention is to provide an injection plug device for injecting concrete repairing agent that makes the repairing operation easy and inexpensive, and in which strongly adhesive epoxy resin is used as the repairing agent.

Another object of the invention is to provide an efficient method for injecting the concrete repairing agent using the injection plug device of the invention.

These and other objects of the present invention will be attained by providing an injection plug device for injecting concrete repairing agent into an injection groove formed in a concrete structure, the injection plug device comprising a rod member inserted into said groove and formed with an injection hole at the center thereof through which said repairing agent is injected, a tube member protruding upwards from the center of said rod member and having an inner end portion communicating with said injection hole of said rod member, a pipe member having an outer end portion and an inner end portion, the inner end portion insertable into said tube member, and a check valve mechanism formed between said inner end portions of said pipe member and said tube member.

In the injection plug device of the present invention, the rod member is inserted into an arcuate injection groove formed in a concrete wall and is adhesively attached to the groove. A motor driven injection pump is connected to the outer end portion of the pipe member through an injection hose and connector. Alternately, a hand injector can be connected directly to the outer end portion of the pipe member. A concrete repairing agent consisting of epoxy resin having relatively strong adhesive properties is injected into the arcuate groove through the pipe member, the inner end portion of the tube member and the through hole of the rod member. Back flow of the repairing agent which may occur during injection and after injection is effectively inhibited by the check valve mechanism formed between the inner end portions of the pipe member and the tube member. After the injected repairing agent has solidified, the tube member protruding upwards from the center of the rod member inserted in the groove is broken by a hammer and removed from the rod member (and thereby removed from the repaired concrete wall) together with the pipe member and the check valve mechanism held in it.

Further details of the present invention will become apparent from the following description of the drawings and the preferred embodiments.

DETAILED DESCRIPTION OF THE PREFERRED EMBODIMENTS

Figure 1:
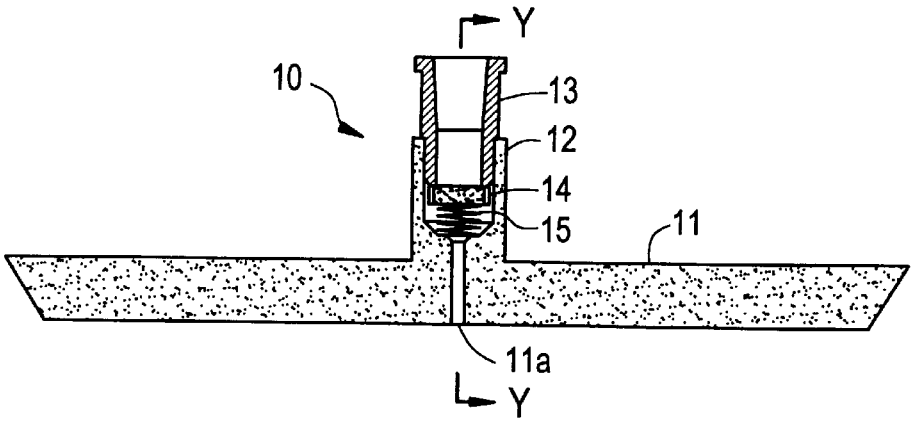
FIG. 1 is a sectional view showing an injection plug device according to an embodiment of the present invention.

FIG. 1 is a sectional view showing an injection plug device 10 for injecting concrete repairing agent according to an embodiment of the present invention. The injection plug device 10 includes a rod member 11, a tube member 12, a pipe member 13 and a check valve mechanism comprising a sheet member 14 and a spring 15.

A rod member 11 is made of the same or similar epoxy resin comprising the concrete repairing agent to be injected through it. The rod member 11 is shaped and sized to be inserted and adhesively attached into an arcuate groove formed in a concrete wall to be repaired using a diamond concrete cutter or the like.

Figure 2:
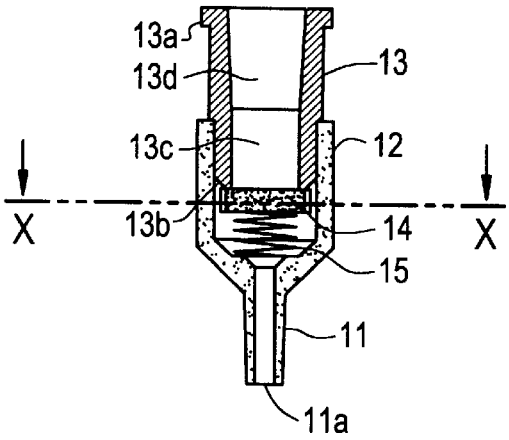
FIG. 2 is a sectional view showing the injection plug device in FIG. 1 taken along a line Y—Y in FIG. 1.

The tube member 12 has a cylindrical shape and extends upwards from a central portion of the rod member 11 and perpendicularly to it. FIG. 2 is a sectional view of the injection plug device 10 taken along the line Y—Y in FIG. 1. The outer diameter of the tube member 12 decreases gradually toward the rod member 11 to form a joint portion of the same width as that of the rod member 11, so that the bottom portion of the tube member 12 has the shape of a funnel. The inner diameter of the tube member 12 also decreases downwards forming the shape of a funnel and communicating with a through hole 11*a* formed in the rod member 11 as a passage for repairing agent to be injected. The rod member 11 and the tube member 12 are formed, as a single member, of epoxy resin.

The pipe member 13 has a generally cylindrical shape, and its inner end portion is inserted into the tube member 12. The depth of insertion of the pipe member 13 into the tube member 12 is kept constant by the abruptly increasing outer diameter of the pipe member 13 at its middle portion. A flange 13*a* for engaging the injection plug device with an injection connector described later is formed on the outer end portion of the pipe member 13. The inner end portion of the pipe member 13 has the shape of a knife edge due to the gradual decrease of its outer diameter downwards. The inner diameter of the pipe member 13 is gradually decreased downwards in its upper portion then kept constant at its bottom portion.

Figure 3:
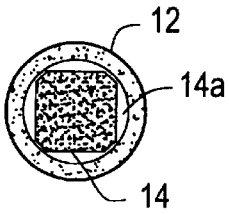
FIG. 3 is a sectional view showing the injection plug device in FIG. 1 taken along a line X—X in FIG. 2.

The check valve sheet 14 is pushed into contact with the inner end portion of the pipe member 13 by the spring 15. The check valve sheet 14 is made of a material having appropriate elasticity and anti-erodent characteristics against the repairing agent, such as rubber. As shown in FIG. 3 (a sectional view taken along X–X' in FIG. 2), the check valve sheet 14 has a substantially rectangular shape with the four corners cut off. In the injection process, the sheet 14 will be displaced downwards by compressing the spring 15 under the pressure of the injected repairing agent, and four arcuate spaces 14*a* will be formed, one between each of the corners of the sheet 14 and the inner surface of the tube member 12, to provide the repairing agent with passages to pass through into the injection hole 11*a* of the rod member 11.

Figure 4:
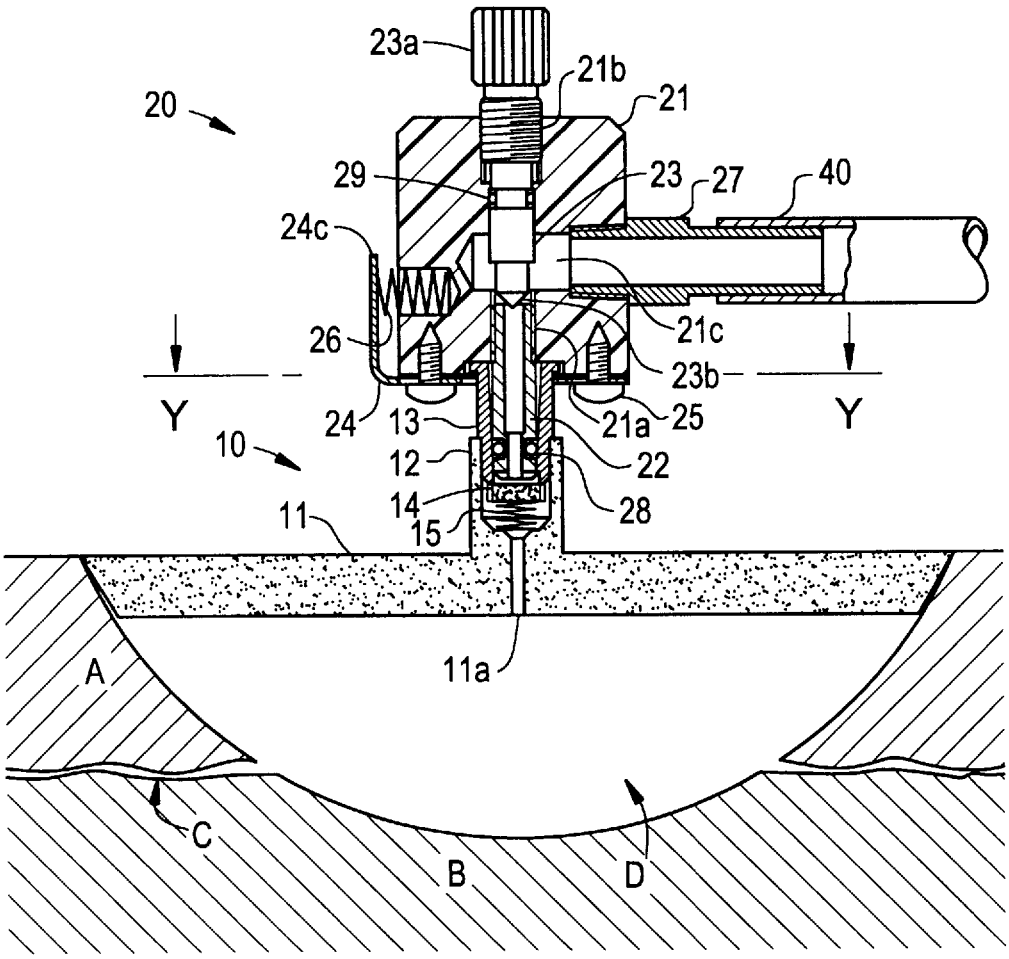
FIG. 4 is a sectional view showing the injection plug device shown in FIGS. 1–3 attached to a concrete wall to be repaired.
Figure 5:
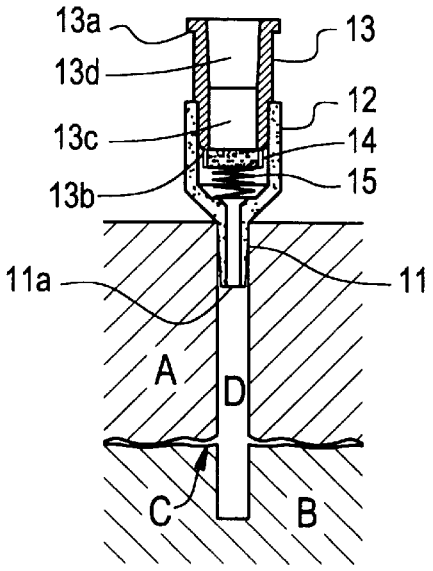
FIG. 5 is a sectional view showing the injection plug device shown in FIGS. 1–3 attached to a concrete wall to be repaired.

FIGS. 4 and 5 show an injection process implemented by using the injection plug device of the present embodiment. A concrete wall to be repaired is formed with an inner concrete body B and an outer mortar layer A, and between them a void C is formed. An arcuate injection groove D is formed into the concrete wall by cutting it with a rotating circular blade, the groove D having a constant width around 3 mm determined by the thickness of the blade, and a depth to allow the groove to reach the void C. The rod member 11 of the injection plug device 10 is inserted into the arcuate groove D after its sides have been coated with adhesive, and is then adhesively fixed in the groove D. The rod member 11 is fixed on the concrete wall with its upper surface at the same height as the outer mortar layer A.

After the injection plug device 10 has been fixed in the concrete wall, a connector 20 attached to a tip end of an injection hose 40 is connected to the outer end portion of the pipe member 13 of the injection plug device 10. The connector 20 includes a main unit 21, an injection nozzle 22, a needle valve 23, a metal attachment 24 and a hose joint 27, which provide the connector 20 with a joint mechanism and a sealing mechanism. The other end of the hose 40 is attached to an injection apparatus including a motor driven pump not shown in the figure.

The main unit 21 of the connector is made of an appropriate anti-erodent material, such as nylon to improve its anti-erodent characteristics and to reduce its weight. A through hole extends vertically through a central portion of the main unit 21 of the connector 20, and threads 21*a* and 21*b* are formed at a bottom and top portion of the through hole respectively. A hole 21*c* is formed to cross the through hole perpendicularly at the center of the main unit 21, and the hose joint 27 is threadingly engaged with thread formed on the inner surface of the hole 21*c*.

The injection nozzle 22 is threadingly attached to the thread 21*a* formed at the bottom of the through hole to protrude downward from the bottom of the main unit 21. The injection nozzle 22 is sized to be insertable into the bottom portion 13*c* of the pipe member 13 of the injection plug device 10, and it also has a liquid sealing mechanism comprising O-ring 28 and a recess to encase the O-ring 28 at its tip portion. The inner diameter of the upper portion of the pipe member 13 gradually increases upwards to accept the injection nozzle easily.

The needle valve 23 is positioned inside the main unit 21 by threadingly attaching its upper portion to the thread 21*b* formed in the through hole of the main unit 21. The tip 23*b* of the needle valve 23 has a conical shape. The needle valve 23 has an adjusting rotor 23*a* at its outer end portion for adjusting the position of the tip 23*b*. The liquid sealing mechanism comprising O-ring 29 and the recess to encase it is formed at the center of the needle valve 23.

A space is formed between the tip 23*b* of the needle valve 23 and the upper end portion of the injection nozzle 22 when the adjusting rotor 23*a* is rotated in a clockwise direction to cause the tip 23*b* to move upward. Through the space and the hole 21*c* a passage is formed for the repairing agent to flow from the injection hose 40 into the injection nozzle 22. When the rotor 23*a* is rotated in the counterclockwise direction, the tip 23*b* will move downward and touch the upper end portion of the injection nozzle 22, and the passage for the repairing agent will be closed and sealed.

Figure 6:
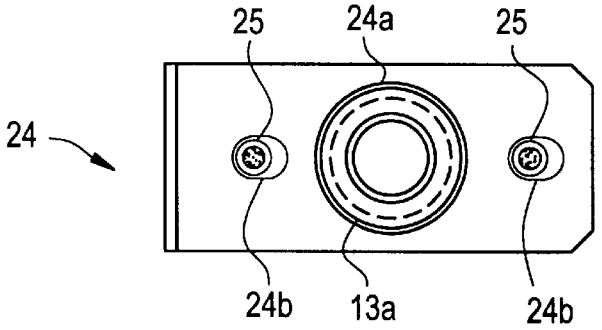
FIG. 6 is a bottom view of the main unit 21 of FIG. 4 showing the connection between the uppermost portion of the injection plug device shown in FIGS. 1–3 and an attachment positioned at the bottom of a connector to be connected to the injection plug device.
Figure 7:
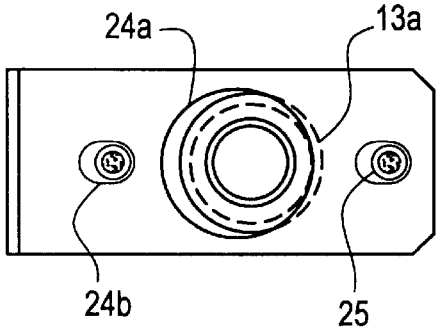
FIG. 7 is a bottom view of the main unit 21 of FIG. 4 showing the connection between the uppermost portion of the injection plug device shown in FIGS. 1–3 and an attachment positioned at the bottom of a connector to be connected to the injection plug device.

The metal attachment 24 is slidably attached to the bottom surface of the main unit 21 of the connector 20 and slides on the bottom surface of the main unit 21. The slidability is provided by two bolts attached to the bottom surface of the main unit 21 and two oval holes of the attachment 24 which loosely engage the two bolts. A spring 26 is held between the side portion of the attachment 24 and a recess formed at one side wall of the main unit 21. The metal attachment 24 is bent perpendicularly to form an "L" shape. FIGS. 6 and 7 show a bottom view of the main unit 21 and the metal attachment 24 attached to the bottom surface of it. A circular hole 24*a* is formed at the center of the metal attachment 24 to allow the flange 13*a* of the pipe member 13 to pass through and engage with it.

At each side of the hole 24*a* positioned in the center of the bottom surface of the metal attachment 24, an oval hole 24*b* is formed, to loosely engage one of the two bolts 25 threadingly attached to the bottom surface of the main unit 21. The hole 24*a* of the metal attachment 24 and the flange 13*a* of the pipe member 13 are shown unengaged in FIG. 6, and are shown engaged in FIG. 7, as the attachment 24 slides along the bottom surface of the main unit 21.

During the injection of the repairing agent, the engagement between flange 13*a* and the hole 24*a* is kept as shown in FIG. 7, by forcing the attachment 24 to slide to a position far from the side wall of the main unit 21 under a driving force of the spring 26.

When the injection of the repairing agent is completed, the engagement between flange 13*a* and the hole 24*a* is released as shown in FIG. 6, by pushing the side portion 24*c* of the attachment 24 towards the side wall of the main unit 21 by opposing the driving force of the spring 26.

To start the injection of the repairing agent, the adjusting rotor 23*a* of the needle valve 23 is rotated in a counter-clockwise direction to allow the repairing agent to flow into the arcuate groove D through the injection nozzle 22, arcuate passage 14*a* formed around the check valve sheet 14, the bottom portion of the tube member 12 where the spring 26 is positioned and the through hole 11*a* extended through the rod member 11. Backflow of the injected repairing agent which might otherwise occur after the void C and groove D are completely filled with the injected repairing agent and before it solidifies can be effectively avoided by the check valve mechanism comprising check valve sheet 14 and the spring 15.

To stop the injection of the repairing agent, the adjusting rotor 23*a* of the needle valve 23 is rotated in a clockwise direction until the conical tip portion of the needle 23*b* contacts the end portion of the injection nozzle 22, thus inhibiting the flow of the repairing agent out of the connector 20. Then, the connector 20 is disconnected from the injection plug device 10 by sliding the attachment 24. Backflow of the injected repairing agent through the injection plug device 10 after disconnection of the connector 20 can be effectively inhibited by the check valve mechanism comprising the check valve sheet 14 and the spring 15.

After the injected repairing agent solidifies, the tube member 12 protruding from the concrete wall perpendicularly is struck with a hammer in a direction parallel to the surface of the wall. The weakest joint portion between the tube member 12 and the rod member 11 (the narrowest portion) is broken by the hammer blow and the tube member 12 can then be removed from the rod member 11 together with the pipe member 13, the check valve sheet 14 and the spring 15.

The tube member 12 and the check valve mechanism, which are intended to be removed from the rod member 11, are all simply constructed, inexpensive parts such as an epoxy resin tube, a rubber sheet and a metal spring. Therefore, cost can be reduced greatly by making these inexpensive parts disposable rather than spending time and labor removing the injection plug device from the wall intact, as practiced in the prior art as described above.

Figure 8:
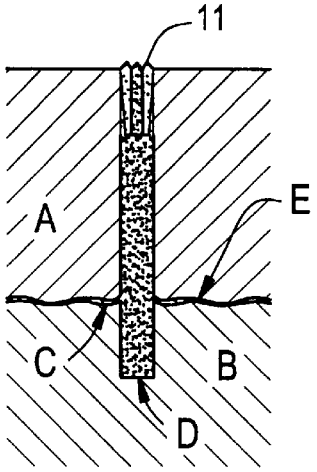
FIG. 8 is a sectional view of the repaired wall in which the injected repairing agent has become solid and only the rod member is left by breaking and removing the tube member.

In FIG. 8, a sectional view of the repaired wall is shown in which the void C and the arcuate groove D are filled completely with solidified repairing agent Only the rod member 11 is left after the tube member 12 is broken and removed from the rod member 11. The rough surface left where the tube member 12 was broken and removed can be smoothed using a sander, then painted with an appropriate surface treatment agent.

Figure 9:
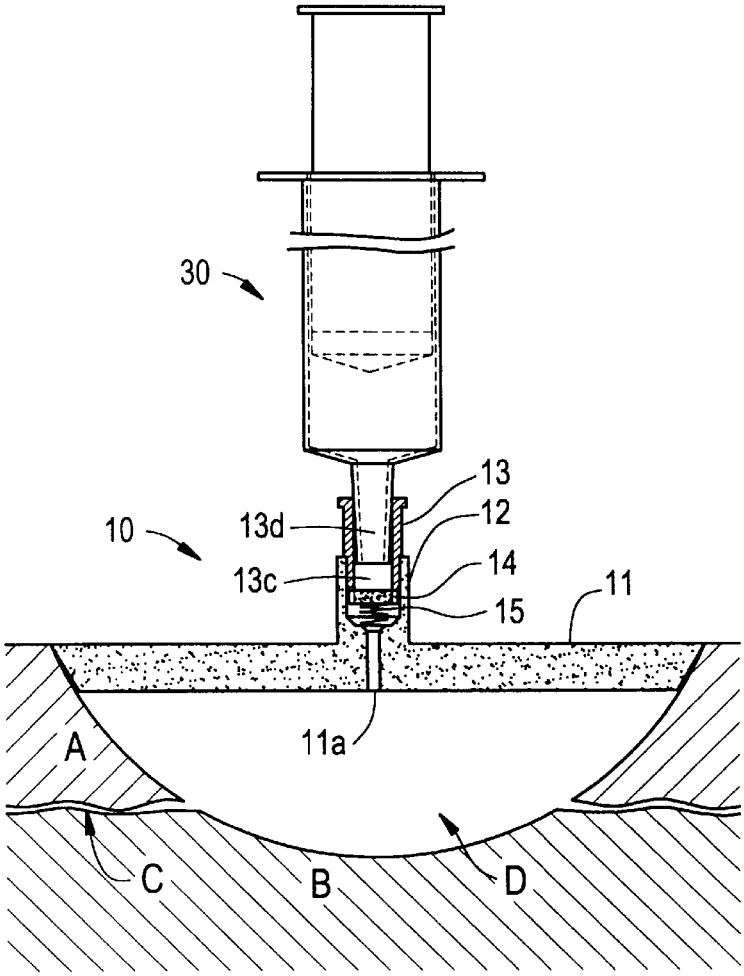
FIG. 9 is a sectional view showing another method of injecting the repairing agent carried out by using the injection plug device shown in FIGS. 1–3.

In FIG. 9, another example of an injection method is shown which can be implemented by using the injection plug device described with reference to FIGS. 1 through 3. According to this injection method, a hand injector or syringe 30 is connected to the injection plug device 10 instead of an injection pump driven by a motor through a connector and hose. The inner surface of the upper portion of the pipe member 13 has a funnel shape as described above to make it easy to accept and guide the tip portion of the syringe 30.

The amount of injected repairing agent can be precisely measured by reading scales displayed on the surface of the syringe 30 (not shown).

Figure 10:
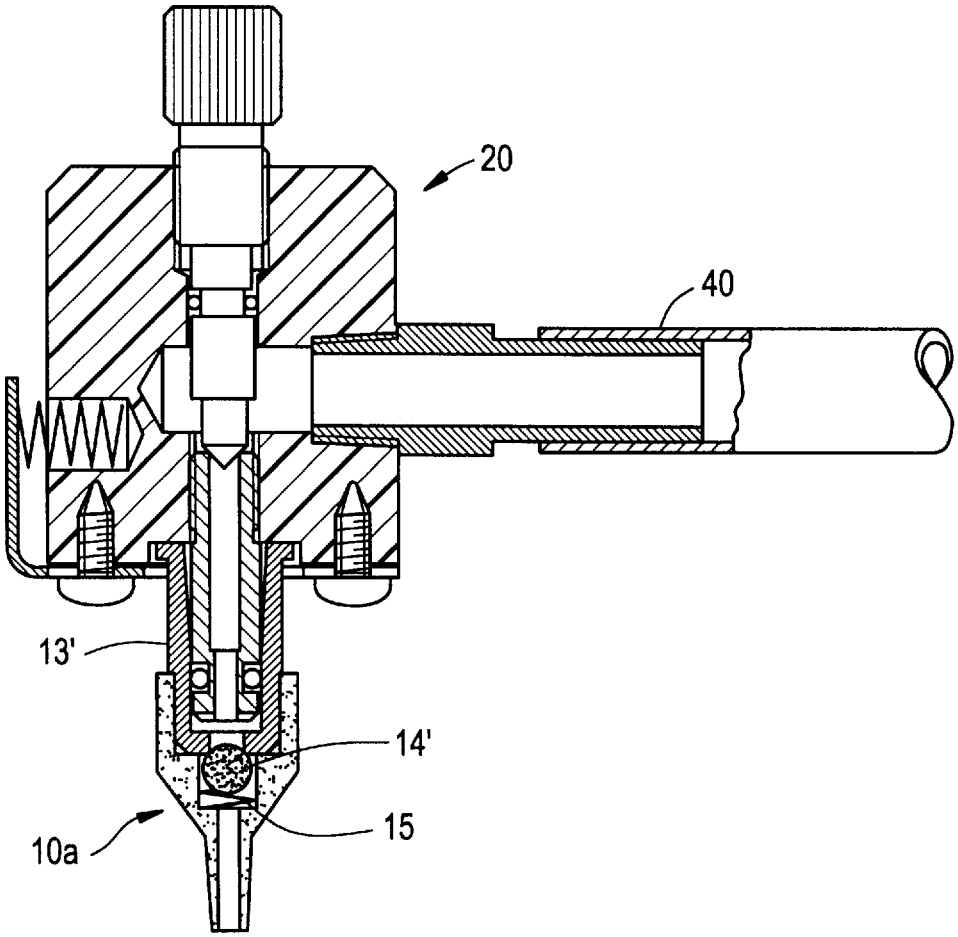
FIG. 10 is a sectional view showing another method of injecting the repairing agent carried out by using an injection plug device according to another embodiment of the invention.

FIG. 10 is a sectional view showing the connection between an injection plug device 10*a* according to another embodiment of the invention and the connector 20 described above. In the injection plug device 10*a*, the check valve sheet described above is replaced by a steel ball 14', and the knife-edged shape of the tip portion of the pipe member 13 shown in FIGS. 1 and 2 is replaced in pipe member 13' of FIG. 10 by a bottom plate having a through hole formed at its center.

Figure 11:
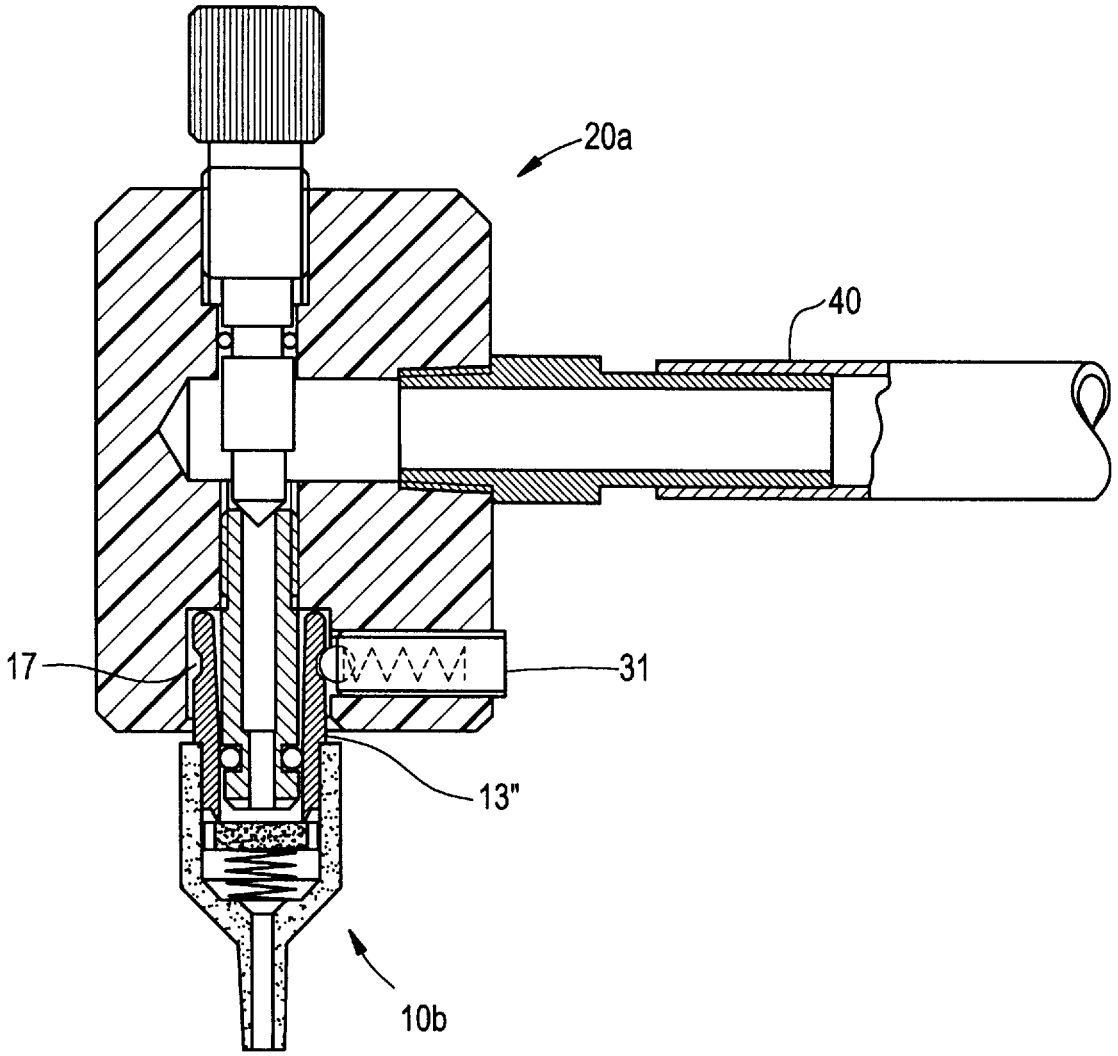
FIG. 11 is a sectional view showing another method of injecting the repairing agent carried out by using the injection plug device shown in FIGS. 1–3 and another connector different from that shown in FIGS. 4 and 10.

FIG. 11 is a sectional view showing a connection between an injection plug device 10*b* according to another embodiment of the present invention and a connector 20*a*. In the injection plug device 10*b*, the knife edge shape of the tip portion of the pipe member 13" is more emphasized than the tip portion of pipe member 13 as shown in FIGS. 1 and 2, and has a "U" shaped groove 17 formed around the outer surface of its upper portion to accept a ball plunger 31 provided to the connector 20*a*. In this structure, the seal between injection plug device 10*b* and connector 20*a* can be improved.

As described above in detail, the injection plug device of the present invention consists of the rod member which is easily attached by adhesives to the arcuate groove, and the tube member which is easily broken and removed from the rod member together with the pipe member and the check valve mechanism after the injected repairing agent has solidified.

Further, the tube member and the check valve mechanism are inexpensive and simply constructed parts such as an epoxy resin tube, a rubber sheet and a metal spring. Cost can be reduced greatly by making these inexpensive parts disposable, rather than spending time and labor removing the injection plug device from the wall as practiced in the prior art.

Furthermore, by making the rod member of the same or almost the same material as the repairing agent, physical and chemical continuity and strength of the repaired portion of the concrete wall are guaranteed, and a decrease of strength in the repaired portion caused by thermal strain and erosion can be effectively avoided.

While the invention has been described in detail and with reference to specific embodiments thereof, it will be apparent to those skilled in the art that various changes and modifications may be made therein without departing from the spirit and scope of the invention.

What is claimed is:

1. A method for injecting a concrete repairing agent into a concrete structure, comprising the steps of:

forming an arcuate injection groove of predetermined width in an outer surface of the concrete structure;

fixing an injection plug device to an upper portion of the arcuate injection groove, the injection plug device comprising a rod member shaped to be received in the upper portion of the arcuate injection groove, the rod member having an injection hole through which the repairing agent is infected, a tube member protruding from the rod member and having an inner end portion communicating with the injection hole of the rod member, a pipe member having an outer end portion and an inner end portion, the inner end portion of the pipe member being inserted into the tube member, and a check valve mechanism formed between the inner end portion of the pipe member and the inner end portion of the tube member;

connecting an injection apparatus to the outer end portion of the pipe member for injecting the repairing agent into the injection groove; and removing the tube member from the rod member by breaking the tube member away from the rod member after the repairing agent has solidified, said method further comprising a step of forming the arcuate groove with a rotating circular blade.

2. A method for injecting a concrete repairing agent into a concrete structure, comprising the steps of:

forming an arcuate injection groove of predetermined width in an outer surface of the concrete structure;

fixing an injection plug device to an upper portion of the arcuate injection groove, the injection plug device comprising a rod member shaped to be received in the upper portion of the arcuate injection groove, the rod member having an injection hole through which the repairing agent is injected, a tube member protruding from the rod member and having an inner end portion communicating with the injection hole of the rod member, a pipe member having an outer end portion and an inner end portion, the inner end portion of the pipe member being inserted into the tube member, and a check valve mechanism formed between the inner end portion of the pipe member and the inner end portion of the tube member;

connecting an injection apparatus to the outer end portion of the pipe member for injecting the repairing agent into the injection groove; and removing the tube member from the rod member by breaking the tube member away from the rod member after the repairing agent has solidified, said method further comprising a step of forming the rod member of an epoxy resin.

3. A method for injecting a concrete repairing agent into a concrete structure according to claim 2, further comprising a step of forming the repairing agent of another epoxy resin.

4. A method for injecting a concrete repairing agent into a concrete structure according to claim 3, wherein said epoxy resin is the same or similar epoxy resin as said another epoxy resin.

5. A device for injecting a repairing agent into an arcuate injection groove formed in a concrete structure, said device comprising:

a rod member shaped to be received in an upper portion of the arcuate injection groove and having an injection hole through which the repairing agent is injected;

a tube member protruding from said rod member and having an inner end portion communicating with the injection hole of said rod member, wherein said tube member is breakably detachable from said rod member to leave only said rod member in the injection groove;

a pipe member being inserted into the tube member, said pipe member having an outer end portion and an inner end portion, the inner end portion of said pipe member being insertable into said tube member, and wherein the inner end portion of said pipe member has a sharp edge; and a connector and an injection apparatus, said connector detachably connecting said injection apparatus to said pipe member, wherein said connector comprises an injection nozzle having a tip portion inserted into said pipe member.

6. A device for injecting a repairing agent into an arcuate injection groove formed in a concrete structure, said device comprising:

a rod member shaped to be received in an upper portion of the arcuate injection groove and having an injection hole through which the repairing agent is injected;

a tube member protruding from said rod member and having an inner end portion communicating with the injection hole of said rod member, wherein said tube member is breakably detachable from said rod member to leave only said rod member in the injection groove;

a pipe member being inserted into the tube member, said pipe member having an outer end portion and an inner end portion, the inner end portion of said pipe member being insertable into said tube member;

a connector and an injection apparatus, said connector detachably connecting said injection apparatus to said pipe member, wherein said connector comprises an injection nozzle having a tip portion inserted into said pipe member and a main unit having means for detachably connecting said main unit to said pipe member;

said main unit having a through hole extending through a portion of said main unit;

said main unit having a cross hole crossing said through hole and communicating with said injection apparatus;

said injection nozzle being disposed in the through hole and protruding from said main unit; and a needle valve adjustably positioned in the through hole for adjusting a flow of the repairing agent from said injection apparatus to the cross hole to the through hole to said pipe member.

7. The device of claim 6, said means for detachably connecting said main unit to said pipe member comprising a groove formed in an outer surface of the outer end portion of said pipe member and a ball plunger provided in said main unit, wherein the groove is shaped to receive said ball plunger.

8. The device of claim 6, said means for detachably connecting said main unit to said pipe member comprising an attachment member slidably attached to said main unit and having a hole through which a flange of said pipe member passes and engages said attachment member, said attachment member being biased toward a position wherein said flange is retained in engagement with said attachment member.

9. A method for injecting a concrete repairing agent into a concrete structure comprising the steps of:

forming an injection groove of predetermined width in an outer surface of the concrete structure, the injection groove communicating with a void or crack in the concrete structure;

fixing an injection plug device in the injection groove, the injection plug device comprising a rod member shaped to be received in the injection groove, the rod member having an injection hole through which the repairing agent is injected, a tube member protruding from the rod member and having an inner end portion communicating with the injection hole of the rod member, and a pipe member having an outer end portion and an inner end portion, the inner end portion of the pipe member being inserted into the tube member;

connecting an injection apparatus to the outer end portion of the pipe member for injecting the repairing agent into the injection groove; and removing the tube member from the rod member by breaking the tube member away from the rod member after the repairing agent has solidified, further comprising a step of forming the rod member of an epoxy resin.

10. An injection plug device for injecting a repairing agent into a void or a crack in a concrete structure through an injection groove formed in the concrete structure, comprising:

a rod member insertable into the injection groove and having an injection hole through which the repairing agent is injected; and a tube member protruding from said rod member and having an inner end portion communicating with the injection hole of said rod member, wherein said tube member is breakably detachable from said rod member to leave only said rod member in the injection groove, said injection plug device further comprising a connector and an injection apparatus, said connector detachably connecting said injection apparatus to said tube member, said connector comprising a pipe member having an outer end portion and an inner end portion, the inner end portion of said pipe member being insertable into said tube member, said connector further comprising:

a main unit having means for detachably connecting said main unit to said pipe member;

said main unit having a through hole extending through a portion of said main unit;

said main unit having a cross hole crossing said through hole and communicating with said injection apparatus;

an injection nozzle disposed in said through hole and protruding from said main unit and insertable in said pipe member; and a needle valve adjustably positioned in the through hole for adjusting a flow of the repairing agent from said injection apparatus to the cross hole to the through hole to said pipe member.

11. A method for injecting a concrete repairing agent into a concrete structure, comprising the steps of:

forming an arcuate injection groove of predetermined width in an outer surface of the concrete structure;

fixing an injection plug device to an upper portion of the arcuate injection groove, the injection plug device comprising a rod member shaped to be received in the upper portion of the arcuate injection groove, the rod member having an injection hole through which the repairing agent is injected, a tube member protruding from the rod member and having an inner end portion communicating with the injection hole of the rod member, a pipe member having an outer end portion and an inner end portion, the inner end portion of the pipe member being inserted into the tube member, and a check valve mechanism formed between the inner end portion of the pipe member and the inner end portion of the tube member;

connecting an injection apparatus to the outer end portion of the pipe member for injecting the repairing agent into the injection groove; and removing the tube member from the rod member by breaking the tube member away from the rod member after the repairing agent has solidified, wherein the arcuate injection groove is a narrow, elongated groove when viewed from above the arcuate injection groove, and wherein the arcuate injection groove has a curved bottom when viewed in a cross-section taken along a length of the arcuate injection groove.

* * * * *